United States Patent [19]

Pearlson

[11] 4,087,979

[45] May 9, 1978

[54] DRYDOCK LIFTING PLATFORM

[75] Inventor: Raymond Pearlson, Miami, Fla.

[73] Assignee: Pearlson Engineering Company, Inc., Miami, Fla.

[21] Appl. No.: 734,642

[22] Filed: Oct. 21, 1976

[51] Int. Cl.[2] ..... B63C 1/09

[52] U.S. Cl. ..... 61/65

[58] Field of Search ..... 61/65, 64, 66, 67; 114/44, 45, 46

[56] References Cited

U.S. PATENT DOCUMENTS

| | | | |
|---|---|---|---|
| 1,380,141 | 5/1921 | Hamilton | 61/65 |
| 3,073,125 | 1/1963 | Pearlson | 61/65 |
| 3,265,024 | 8/1966 | Kramlich | 61/65 X |
| 3,626,447 | 12/1971 | Hindlin | 61/65 |

FOREIGN PATENT DOCUMENTS

| | | | |
|---|---|---|---|
| 2,132,142 | 1/1973 | Germany | 61/65 |

*Primary Examiner*—Jacob Shapiro

*Attorney, Agent, or Firm*—Mason, Fenwick & Lawrence

[57] ABSTRACT

A lifting platform of a drydock has plural sections along its length pivoted together at transverse support beams supported at each end by winch cables; flotation chambers in other embodiments contain air or foamed resin and are always below the lowest water level to offset 75% to 90% of the platform weight and reduce cable load.

35 Claims, 9 Drawing Figures

DRYDOCK LIFTING PLATFORM

This invention is in the field of maritime maintenance facilities and is specifically directed to a new and improved lifting type drydock means and even more specifically to a lifting platform therefor.

Drydocks of the general type disclosed in my U.S. Pat. No. 3,073,125 employs a lifting platform supported for vertical movement by a plurality of synchronous motor driven winches connected to the ends of main transverse support or lifting beams of the platform for lifting and lowering the platform along with any ship or vessel carried thereon. The aforementioned patent discloses longitudinally extending beams extending perpendicular to the main transverse support beams parallel to the length of the platform which are provided with ears on each end through which pins pass to connect the beams to the main transverse support beams to which the lifting winches are connected. Since each of the main transverse load carrying beams is simply supported at each end, the beams are capable of a certain amount of undesirable pivotal twisting movement about their longitudinal axis when subjected to torsional loads as frequently occurs as the result of one or more of the longitudinal beams being subjected to heavier loads than the beams on the other side of a particular main lifting beam. Another drawback of prior drydock constructions is that they require complete fabrication assembly of the lifting platform at the installation site in that their construction is such that prefabrication of the components is not feasible. Consequently, substantial labor costs are incurred at the site of the installation.

Another problem with the previously known winch operated lifting type drydocks is the fact that the lifting platform itself must be formed of large heavy duty beams and other components which are quite heavy and which must also obviously be lifted along with the weight of the vessel supported by the platform. In fact, the lifting platform itself is frequently substantially heavier than the vessel being lifted. While counterbalancing of the platform weight is feasible in some instances, it adds substantially to the complexity and cost of the system. The foregoing facts necessitate the employment of extremely powerful heavy duty winches capable of lifting the total weight of the platform as well as the vessel carried by the platform. Conseqeuently, the size of the vessels that can be handled by drydocks of this type is limited due to the massive weight of the platform itself. As a result, larger ships and vessels which are too heavy to be lifted on a lifting type drydock must be accommodated by the expensive and sometimes difficult to secure floating drydocks.

Therefore, it is the object of the present invention to provide a new and improved drydock construction.

A further object of the invention is the provision of a new and improved lifting type drydock construction.

Yet another object of the invention is the provision of a new and improved lifting type drydock construction in which the lifting platform is capable of being prefabricated and assembled at the installation site.

A further object of the invention is the provision of a new and improved lifting type drydock platform in which the main lifting beams are connected to means resisting their torsional rotation but with the overall platform retaining sufficient flexibility to accommodate varying loads along its length.

Yet another object of the invention is the provision of a lifting type drydock having means to offset a substantial portion of the weight of the lifting platform to reduce the load on the lifting winches.

Achievement of the foregoing objects is enabled by the preferred embodiments of this invention all of which employ a plurality of parallel transverse main lifting beams each connected on its ends to a lifting winch by means of a cable extending from the winch. The lifting platform is formed of a plurality of platform sections of given width extending transversely across the length of the platform.

In a first embodiment, each platform section includes a main transverse lifting beam of I-beam configuration to the main web of which one end of a plurality of longitudinally extending lifting beams also of I-beam configuration are welded or otherwise fixedly connected to extend in a horizontal manner. The opposite or free ends of the longitudinal lifting beams are loosely mounted on the main lifting beam of a next-adjacent platform section with each free end including a downwardly extending retaining lug welded on the lower flange of the beam positioned inwardly of an upwardly extending fixed lug mounted on the upper surface of a horizontal saddle plate welded to the next-adjacent main lifting beam. Consequently, the fact that the longitudinally extending beams are welded to one of the main transverse support beams provides rotational stability for the support beams due to the lever effect of the longitudinally extending beams connected to the main beam.

In a second embodiment, two types of platform sections are provided with the different platform sections alternating along the length of the platform. The first group of platform sections consist of a pair of main transverse support beams between which a plurality of longitudinal beams extend with the longitudinal beams being welded at each end to the main transverse support beams so as to provide a rigid platform section. However, the second group of platform sections comprises a plurality of parallel longitudinal beams each pivotally connected on both ends to the adjacent main transverse support beams of the adjacent platform sections of the first group. Consequently, the platform sections of the second group are pivotally connected to the platform sections of the first group to provide an overall platform flexibility with the fact that the main transverse support beams are connected by the longitudinal beams extending between the support beams and welded thereto providing substantial resistance to torsional twisting of the support beams.

In another embodiment, the platform sections are provided with floatation means consisting of either an air tank or a tank filled with expanded synthetic resinous materials such as sold under the trademark "Styrofoam" positioned between the longitudinally extending beams and the main transverse lifting beams with the buoyancy means having the capacity for providing an upward buoyant force equal to approximately 90% of the weight of the entire lifting platform when the buoyancy means is immersed in the body of water with which the installation is associated. Such installations are of particular value only in locations in which there is a minimum vertical differential between the maximum high tide and the maximum low tide since the floatation chambers must always be positioned beneath the surface of the water so as to provide their full buoyant lifting effect at all times. This result is achieved by carefully selecting the installation site at a geographic location where there is no great tidal fluctuation and by designing the uppermost limit position of the platform and the vertical spacing below the upper part of the platform of of the flotation chamber so that the flotation chamber is always below the water level even when the tide is at its lowest possible position and the lifting platform is in its maximum elevated position. As a consequence of the foregoing construction, substantially smaller winches and cables can be employed for lifting the platform since the weight of the ship and only a small percentage of the platform weight such as in the order of 10% - 25% need be lifted whereas in previous installations it has been necessary to provides winches capable of lifting the sum total of the weight of the platform and the ship. Alternatively, by using winches of the same type presently used it would be possible to lift much heavier ships than is now the case with the presently known constructions.

A better understanding of the preferred embodiments of the invention will be achieved when the following written description is considered in conjunction with the appended drawings in which.

Figure 1:
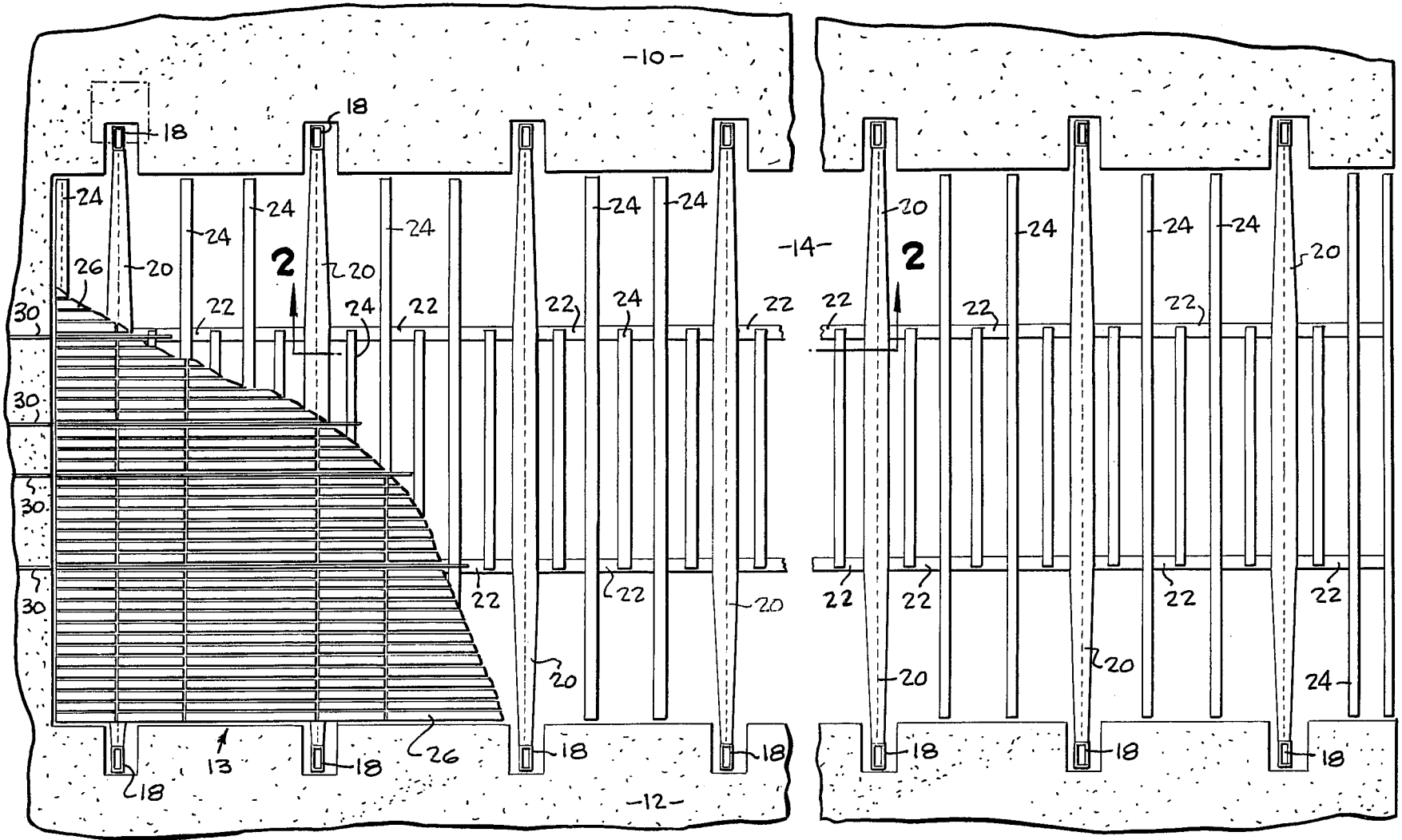
FIG. 1 is a top plan view of a drydock in accordance with the preferred embodiments of the invention.
Figure 2:
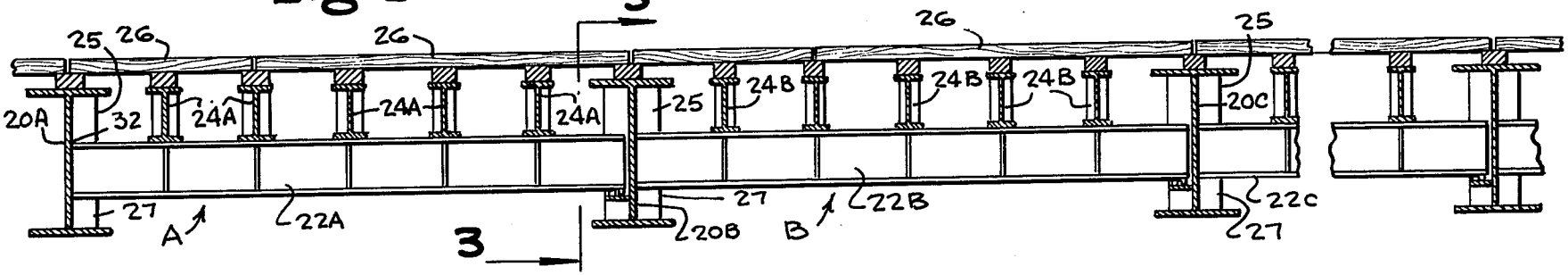
FIG. 2 is a sectional view taken along lines 2—2 of FIG. 1.

Attention is initially invited to FIG. 1 of the drawings which comprises a plan view of a drydock installation provided adjacent a body of water including a lifting platform support means consisting of a pair of parallel concrete piers 10 and 12 between which a slip 14 is provided of sufficient depth to receive ships or other vessels to be removed from the water for maintenance purposes. A vertically movable lifting platform 13 extends between the piers 10 and 12 and is supported for vertical movement by cable members 16 extending about pulley sheaves 18 (FIG. 3) mounted in the ends of main transverse support beam members 20 extending transversely across the width of the slip 14 as best illustrated in FIG. 1. Main transverse support beams 20 provide support for the remaining portions of the lifting platform including a plurality of longitudinal beams 22 connected to and supported by the main transverse support beams 20 in a manner to be discussed hereinafter. Moreover, the longitudinal beams 22 provide support for secondary transverse support beams 24 connected to and supported on the upper surface of beams 22. It will be noted that alternate ones of the beams 24 extend substantially the entire width of the platform while the other beams merely extend between the longitudinal beams 22. Lifting platform 17 also includes upper timber decking components 26 supported on the upper surfaces of beams 20 and 24. Additionally, the platform 17 can include platform rail members 28 for supporting a movable railway type carriage if desired. Rail members 28 would be provided in alignment with inland transfer rails 30 for effecting movement of any such carriage from the platform inland away from the drydock such as for the purpose of conveying a ship or vessel to a work station. In any event, the arrangement of the main transverse support beams and the longitudinal beams 22 is of particular significance to the subject invention. Platform 17 is divided into a plurality of rigid unitary sections extending across the width of the platform and bounded by the main transverse lifting beams 20 with the construction in a first embodiment being as shown in FIG. 2. Specifically, FIG. 2 illustrates two complete adjacent sections "A" and "B" of the platform with the remaining platform sections being connected in exactly the same manner along the entire length of the platform. The component parts of platforms "A" and "B"0 are designated by the same designators discussed above with the suffix "A" or "B" being added for the parts of the respective sections so as to provide a clear illustration of the extend of each section.

The first platform section "A" consists of a single main transverse lifting beam 20A to the main vertical web of which the longitudinal beams 22A are welded as shown at 22 between an upper spacer plate 25 and a lower spacer plate 27. Secondary transverse support beams 24A are supported on the upper surface of the beams 22A with the timber decking 26 being supported on the upper surface of the beams as shown.

The second complete section "B" which is adjacent the first section "A" consists of a main transverse support beam 20B and a pair of longitudinal beams 22B which are welded to the right side of the main web of main transverse beam 20B. However, the main transverse support beam 20B is provided on the left side of its main web with means for pivotally supporting the free ends of longitudinal beams 22A of the first platform section "A."

Figure 3:
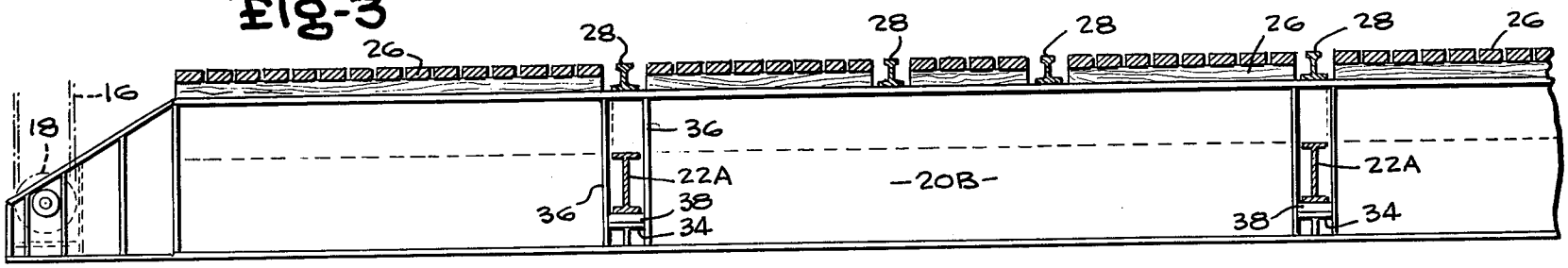
FIG. 3 is a sectional view taken along lines 3—3 of FIG. 2.
Figures 5, 6:
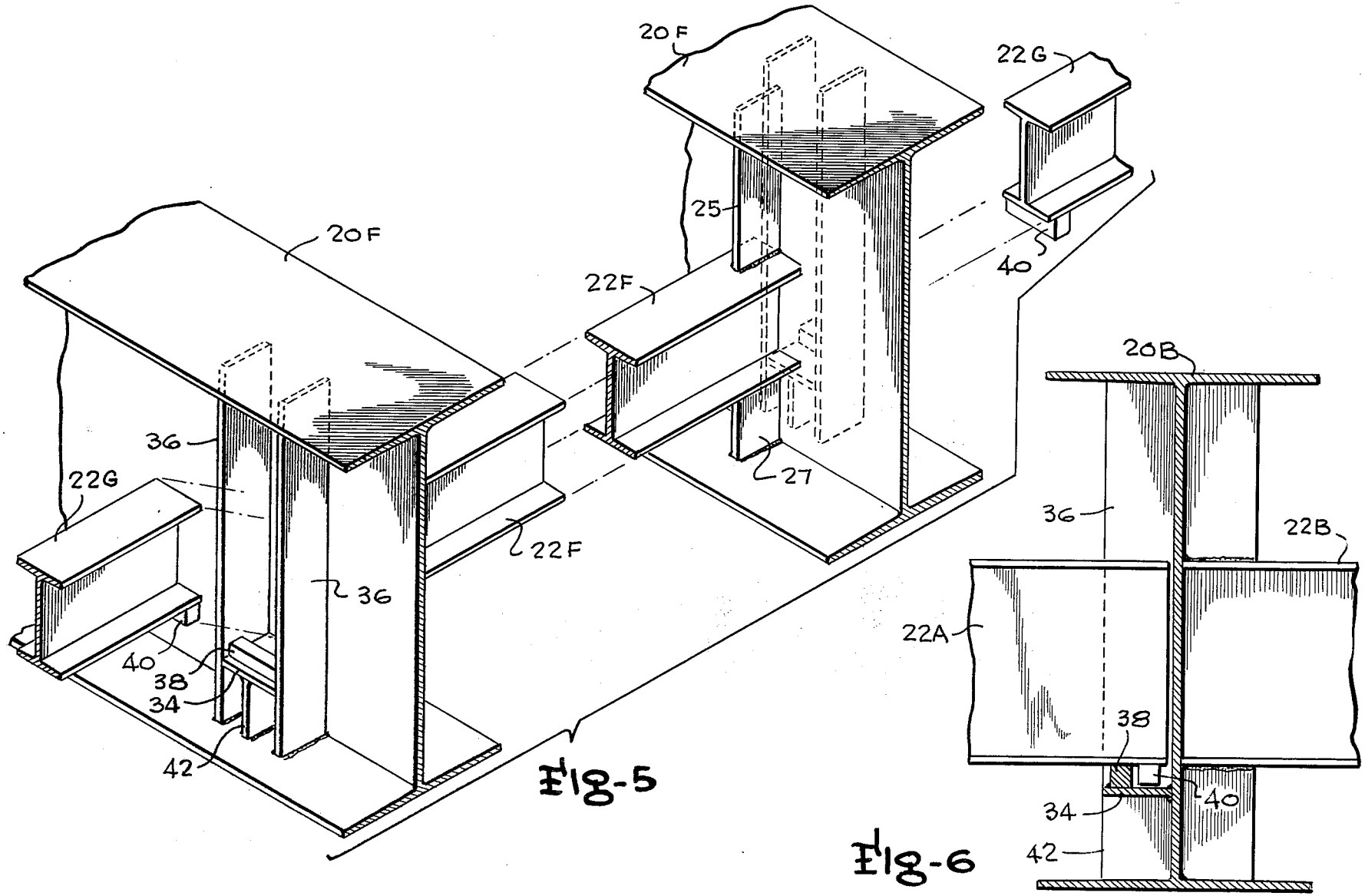
FIG. 5 is an exploded perspective view of a portion of the embodiment of FIG. 4.
FIG. 6 is an enlarged view of a portion of FIG. 2.

The pivotal support for the free end of beams 22A is best illustrated in FIGS. 3 and 6 (an identical support for a different beam 22G is also shown in FIG. 5) and includes a horizontal saddle plate 34 welded to the main web of beam 20B positioned above the lower flange of the main transverse beam between vertical stiffener plates 36 welded to beam 20B and spaced apart sufficiently to receive the end of beam 22A. An upwardly extending retaining lug 38 is welded to the upper surface of the saddle plate 34 to cooperate with a retaining lug 40 extending downwardly from the lower flange of beam 22A. Additional support for the saddle plate 34 is provided by a center support plate 42 welded between the lower surface of saddle plate 34 and a lower flange of the main transverse support beam 20B. Consequently, it will be seen that the free end of the longitudinal beams 22A is pivotally supported with respect to the main transverse beam 20B so that the platform section A is capable of limited pivotal movement with respect to the platform section B. It will be understood that the number of sections in any particular lifting platform will vary in accordance with the size of the installation. The pivotal connection between the free ends of the longitudinal beams 22 and the adjacent main transverse beam of the next adjacent section provides for sufficient movement of the platform to accommodate the unbalance of load on the platform as frequently occurs while the unitary rigid platform section provides adequate rigidity necessary for a stable support of the load on the platform.

Figure 4:
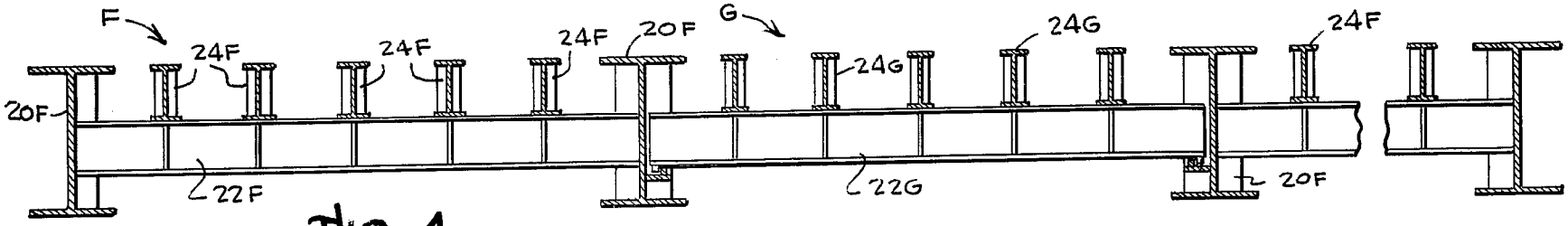
FIG. 4 is a sectional view similar to FIG. 2 but illustrating a second embodiment of the invention.

FIG. 4 illustrates a second embodiment of the invention, and FIG. 5 illustrates parts thereof, in which a multi-section platform is formed of two groups of platform sections consisting of alternate sections F and G respectively differing in the manner in which the longitudinal beams of the sections are connected to the main transverse support beams. More specifically, the longitudinal beams 22F of sections F are welded at both ends to the support beams 20F in exactly the same manner that the beams 22A are welded to beams 20A in the obviously discussed embodiment of FIGS. 2 and 3. The secondary transverse beams 24F are welded to the upper surface of the longitudinal beams 22F in the same manner that the previously discussed beams 24A etc. are supported on their longitudinal beams. Section G, on the other hand, has its longitudinal beams 22G pivotally connected to the main transverse support beams 20F adjacent each end of beams 22G in exactly the same manner that the free ends of beams 22A are connected to the beams 20B of the first embodiment and which is best illustrated in FIG. 5.

The embodiment of FIGS. 4 and 5 also provides flexibility between adjacent sections while preventing the rotation of the main transverse support beams by torsional loads.

Figure 7:
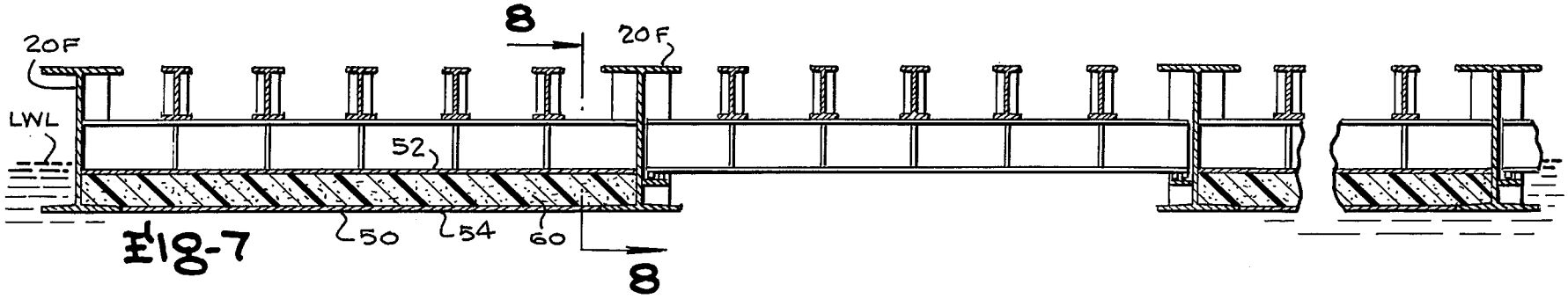
FIG. 7 is a sectional view similar to FIG. 2 illustrating a third embodiment of the invention.
Figure 8:
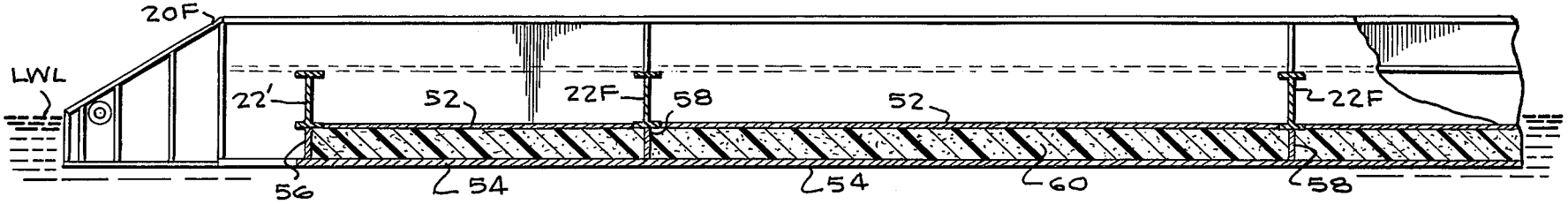
FIG. 8 is a sectional view taken along lines 8—8 of FIG. 7.

FIG. 7 illustrates a variation in the embodiment of FIGS. 4 and 5 in that it constitutes a sectional view of a portion of a lifting platform in its upper limit position of movement (i.e. the highest position to which the winches can lift the platform) with the lowest possible water level LWL as shown with respect to the platform. The embodiment of FIGS. 7 and 8 is exactly identical to the embodiment of FIG. 4 with the exception that tank 50 is formed between upper plates 52, lower plates 54, the main webs of the main transverse support beams 20F and side plates 56 (only one of which is shown beneath a supplemental longitudinal beam 22'). Tank 50 is subdivided by plates 58 and encloses blocks of expanded synthetic resinous material 60 such as that sold under the trademark "Styrofoam." The buoyancy tank 50 cooperates with similar buoyancy tanks provided along the length of the platform in the sections F so that the buoyant effect of the tanks is equal to a substantial portion of the weight of the entire platform such as in the order of 75% to 90%, for example.

The number, thickness and location of the buoyancy tanks 50 can obviously be varied in accordance with the weight of the particular platform with which they are associated. Additionally, it should be understood that buoyancy tanks of the type illustrated in FIGS. 7 and 8 can also be incorporated in the other embodiments of the invention by merely welding similar tanks to the lower surfaces of the longitudinal beams such as beams 22A of the embodiment of FIGS. 2 and 4. It is of critical importance that the buoyancy tanks 50 be located in the lower portion of the lifting platform so that they are always below the low water level LWL even when the platform is in its uppermost limit position as illustrated in FIG. 7 so that the buoyancy effect of the tanks is always provided to the fullest extent possible. Consequently, the weight of the platform is largely offset for all positions of the platform and the lower requirements of the lifting winches ae not nearly as great as they would be if it were not for the presence of the buoyancy tanks.

Figure 9:
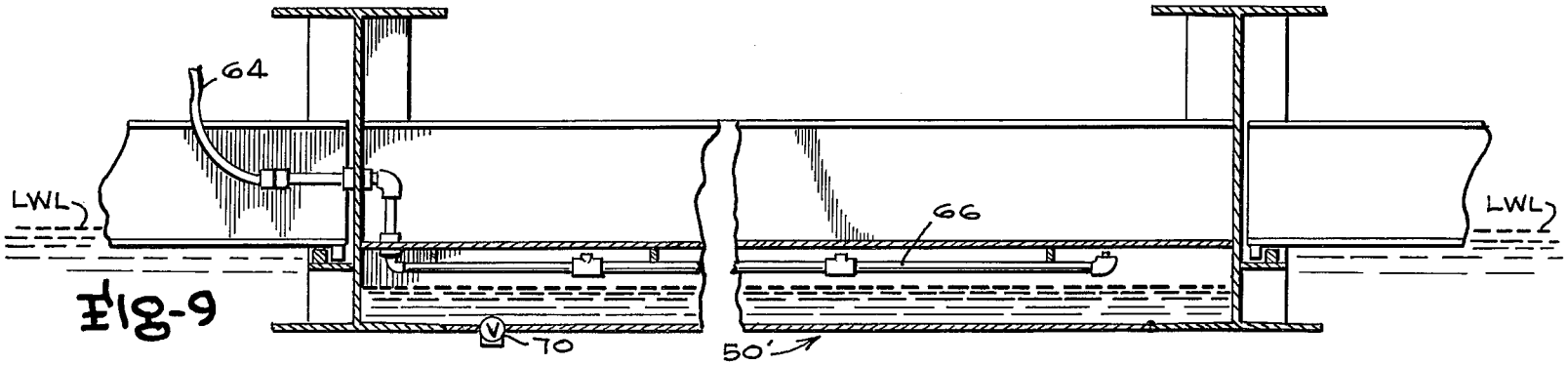
FIG. 9 is a sectional view similar to FIG. 2 but illustrating a fourth embodiment of the invention.

FIG. 9 illustrates another embodiment quite similar to that of FIGS. 7 and 8 in that buoyancy tanks 50' are provided in the same location as buoyancy tanks 50. However, the buoyancy tanks 50' are different in that they are air tanks in that they do not incorporate resinous foam material in the manner of the tanks 50. Tanks 50' are connected to an air line 64 and have an inlet pipe 66 on their interior so that compressed air can be provided on the interior of the tanks to force the water in the tanks outwardly through valve means 70 to provide a desired amount of buoyancy. It should also be appreciated that the platform section illustrated in FIG. 9 is shown in its upper limit position of movement in conjunction with the lowest possible water level LWL and that the tank 50' is consequently always completely submerged below the water level so as to provide for its full buoyancy effect if desired. Obviously, the buoyancy effect provided by tank 50' can be varied in accordance with the amount of air introduced into the tank.

Additionally, it would also be possible to use combinations of the foam containing tanks 50 and the air tanks 50' if desired. Numerous other modifications of the subject invention will undoubtedly occur to those of skill in the art and it should be understood that the spirit and scope of the invention is limited solely by the appended claims.

I claim:

1. A lifting type drydock having an elongated vertically movable multi-section platform including a plurality of platform sections each extending across the width of said platform and hingedly connected along adjacent edge portions to the next adjacent platform section, each of said platform sections including a main transverse lifting beam extending across the width of the platform section along one edge of the platform section, a plurality of longitudinal beams fixedly connected on one end to said main transverse beam and having their opposite ends pivotally connected to and supported by the main transverse beam of a next-adjacent platform section, secondary transverse support beams fixedly connected to said longitudinal beams and power driven lifting support means connected to the ends of said main transverse beams for lifting or lowering said main transverse beams to effect a unitary vertical movement of said movable multi-section platform.

2. The invention of said claim 1 wherein said main transverse lifting beams are I-beams and said longitudinal beams each comprise an I-beam of a height less than the height of said main transverse lifting beams.

3. The invention of claim 2 additionally including horizontal saddle plate members each respectively fixedly positioned on one of said main lifting beams beneath the ends of and providing support for said longitudinal beams adjacent the web of each of said main transverse lifting beams upwardly spaced above the lower flange of the respective main transverse lifting beam on which said saddle plates are mounted.

4. The invention of claim 3 wherein the pivotally connected ends of said longitudinal beams each include holding lug means extending downwardly from the lower flange of the longitudinal beam in a position adjacent the pivotally mounted end of the longitudinal beam and wherein the saddle plate members beneath the pivotally mounted end of said longitudinal beam each include an upwardly extending retaining lug means cooperable with said holding lug means for preventing axial movement of the pivotally supported end of each longitudinal beam from its supported position on the saddle plate.

5. The invention of claim 4 additionally including vertical stiffener plates fixedly attached to said main transverse lifting beams on opposite sides of said saddle plates supporting the pivotally mounted ends of said longitudinal beams for retaining said longitudinal beam ends from sidewise movement.

6. The invention of claim 1 wherein said main transverse lifting beams, said longitudinal beams and said secondary transverse beams are all I-beams.

7. The invention of claim 6 wherein the upper surfaces of said main transverse lifting beams and said secondary transverse support beams are positioned in a common horizontal plane.

8. The invention of claim 7 additionally including horizontal saddle plate members each respectively fixedly positioned on one of said main lifting beams beneath the ends of and providing support for said longitudinal beams adjacent the web of each of said main transverse lifting beams upwardly spaced above the lower flange of the respective main transverse lifting beam on which said saddle plates are mounted.

9. The invention of claim 6 wherein the pivotally connected ends of said longitudinal beams each include holding lug means extending downwardly from the lower flange of the longitudinal beam in a position adjacent the pivotally mounted end of each longitudinal beam and wherein the saddle plate members beneath the pivotally mounted end of each longitudinal beam each include an upwardly extending retaining lug means cooperable with said holding lug means for preventing axial movement of the pivotally supported end of each longitudinal beam from its supported position on its respective supporting saddle plate.

10. The invention of claim 9 additionally including vertical stiffener plates fixedly attached to said main transverse lifting beams on opposite sides of the saddle plate members supporting the pivotally mounted ends of said longitudinal beams for retaining said longitudinal beam ends from sidewise movement.

11. A lifting type drydock including an elongated vertically movable multi-section platform formed of a plurality of platform sections each extending across the width of said platform and hingedly connected along adjacent edge portions to the next adjacent platform section, said multi-section platform including a plurality of main transverse lifting beams extending across the width of the platform, a plurality of longitudinal beams extending between and supported by said main transverse lifting beams, each of said main transverse lifting beams being pivotally connected on one side to the ends of a first group of said longitudinal beams and being fixedly connected on its opposite side to the ends of a second group of said longitudinal beams, secondary transverse support beams mounted on said longitudinal beams and power driven cable means connected to the ends of said main transverse beams for lifting or lowering said main transverse beams to effect vertical movement of said movable multi-section platform.

12. The invention of claim 11 wherein the individual beams of said second group of longitudinal beams are fixedly connected on each of their ends to two main transverse beams between which said beams of said second group extend and said individual beams of said first group of longitudinal beams are pivotally connected on each of their ends to two main transverse lifting beams between which said beams of said first group of longitudinal beams extend.

13. The invention of claim 12 additionally including buoyancy providing tank means fixedly positioned between said beams of said second group and the main transverse lifting beams to which said second group of longitudinal beams is connected.

14. The invention of claim 13 wherein said buoyancy providing tank is a variable buoyancy air tank.

15. The invention of claim 13 wherein said buoyancy providing tank comprises a "Styrofoam" filled tank.

16. The invention of claim 12 wherein said main transverse lifting beams and said longitudinal beams are I-beams.

17. The invention of claim 16 additionally including horizontal saddle plate members each respectively mounted on a main lifting beam fixedly positioned beneath the ends of and providing support for said first group of longitudinal beams adjacent the web of each of said main transverse lifting beams of said first group of beams upwardly spaced above the lower flange of the respective transverse lifting beam on which said saddle plates are mounted.

18. The invention of claim 17 wherein the pivotally connected ends of said first group of longitudinal beams each include holding lug means extending downwardly from the lower flange of the longitudinal beams of the first group of longitudinal beams in a position adjacent the pivotally mounted end of said longitudinal beams and wherein the saddle plate members beneath the pivotally mounted end of said longitudinal beams each include an upwardly extending retaining lug means cooperable with said holding lug means for preventing axial movement of the pivotally supported end of each longitudinal beam of said first group from its supported position of the saddle plate.

19. The invention of claim 18 additionally including vertical stiffener plates fixedly attached to said main transverse lifting beams on opposite sides of said saddle plates supporting the pivotally mounted ends of said first group of longitudinal beams for retaining the ends of said longitudinal beams from sidewise movement.

20. The invention of claim 18 additionally including buoyancy providing tank means fixedly positioned between said beams of said second group and the main transverse lifting means to which said second group of longitudinal beams is connected.

21. The invention of claim 20 wherein said buoyancy providing tank is a variable buoyancy air tank.

22. The invention of claim 20 wherein said buoyancy providing tank comprises a "Styrofoam" filled tank.

23. The invention of claim 11 wherein said longitudinal beams of said second group of longitudinal beams are fixedly connected to the respective sides of said main transverse lifting beams facing one end of said multi-section platform.

24. The invention of said claim 23 wherein said main transverse lifting beams and said longitudinal beams are I-beams.

25. The invention of claim 24 additionally including horizontal saddle plate members each respectively fixedly positioned beneath the ends of and providing support for said longitudinal beams of said first group of longitudinal beams, said saddle plates being respectively mounted on one of said main transverse lifting beams adjacent the web thereof.

26. The invention of claim 12 additionally including buoyancy providing tank means fixedly positioned between said beams of said second group and the main transverse lifting beams to which said second group of longitudinal beams is connected, said buoyancy providing tank means provides an upward force on said platform in an amount so that no more than approximately 10% of the weight of said platform is supported by said power-driven cable means.

27. The invention of claim 26 wherein said platform is movable between an upper limit position above which it cannot move and a lower position, said buoyancy providing tank means being positioned on said platform in a sufficiently low position to insure that said buoyancy tank means is always below the water level of the body of water with which the platform is associated even when said platform is in its upper limit position.

28. The invention of claim 27 wherein said buoyancy providing tank is a variable buoyancy air tank.

29. The invention of claim 27 wherein said buoyancy providing tank comprises a "Styrofoam" filled tank.

30. The invention of claim 26 wherein said buoyancy providing tank is a variable buoyancy air tank.

31. The invention of claim 26 wherein said buoyancy providing tank comprises a "Styrofoam" filled tank.

32. A drydock installation on a body of water having a maximum water level and a minimum water level, a fixed support, movable ship lifting platform means supported by said fixed support by power driven winch means mounted on said fixed support and connected to said movable platform, said platform being movable between an upper limit position and a lower limit position, buoyancy tank means on said platform submerged in said body of water providing a substantial upward buoyant force on said platform wherein said buoyancy tank means is positioned on said platform in a position to be substantially immersed in said body of water when said body of water is at its minimum water level and said platform is concurrently in its upper limit position so that the buoyancy tank means is always effective to provide said upward buoyant force on said platform for all positions of said platform.

33. The invention of claim 32 wherein said buoyancy tank means comprises air tank means.

34. The invention of claim 32 wherein said buoyancy tank means comprises a tank containing plastic foam material.

35. The invention of claim 1 additionally including buoyancy providing tank means mounted on said platform sections for providing a buoyant force which is less than the weight of said platform sections.

* * * * *